US005459903A

United States Patent [19]

Treacy

[11] Patent Number: 5,459,903

[45] Date of Patent: Oct. 24, 1995

[54] METHOD AND APPARATUS FOR SUPPORTING AN ITEM PROXIMATE TO A PERSON'S MOUTH

[76] Inventor: Brian M. Treacy, 624 S. Taylor, Oak Park, Ill. 60304

[21] Appl. No.: 168,642

[22] Filed: Dec. 16, 1993

[51] Int. Cl.[6] ..... A47D 15/00; A44B 21/00

[52] U.S. Cl. ..... 24/3.13; 24/301; 24/115 G; 248/102

[58] Field of Search ..... 24/3 M, 3 J, 3 L, 24/301, 302; 248/102; 224/252

[56] References Cited

U.S. PATENT DOCUMENTS

| | | | |
|---|---|---|---|
| 1,187,845 | 6/1916 | Kolb | 248/102 |
| 1,559,740 | 11/1925 | Cardarella | 248/102 |
| 1,782,057 | 11/1930 | Bollinger | 24/301 |
| 2,084,243 | 6/1934 | Charles | 248/102 |
| 2,288,692 | 7/1942 | Pearson | 24/302 |
| 2,637,515 | 5/1953 | Walsh | 248/102 |
| 2,815,909 | 12/1957 | Paprocki et al. | 248/102 |
| 4,121,797 | 10/1978 | MacNeil | 248/102 |
| 4,328,605 | 5/1982 | Hutchison et al. | 24/115 G |
| 4,765,037 | 8/1988 | Perry | 24/301 |
| 5,150,504 | 9/1992 | Cohen | 24/3 M |

*Primary Examiner*—Victor N. Sakran
*Attorney, Agent, or Firm*—Wallenstein & Wagner, Ltd.

[57] ABSTRACT

A method, apparatus and system for supporting an oral device proximate to a person's mouth is disclosed. The person is disposed on a body support having a superstructure positioned above the person, such as a baby seat. The apparatus comprises a cord having a generally central portion and first and second distal sections. The first and second distal sections terminate at respective first and second ends. A adjustable clamp joins portions of the first and second distal sections, the clamp forming a loop portion of the cord having an adjustable circumference adapted for adjustably gripping the oral device. Spring-biased clips are adapted for securing each of the first and second ends to the superstructure. The oral device comprises a pacifier, a food item, a feeding device such as a baby bottle, or the like. The method and system utilize the apparatus in conjunction with the body support.

6 Claims, 1 Drawing Sheet

METHOD AND APPARATUS FOR SUPPORTING AN ITEM PROXIMATE TO A PERSON'S MOUTH

FIELD OF THE INVENTION

The application relates to a feeding method and apparatus and, more particularly, to a method and apparatus for supporting an oral device, such as a baby bottle, proximate to the mouth of a person, such as an infant in a baby seat carrier.

BACKGROUND OF THE INVENTION

Various methods and apparatuses have been suggested to readily assist in the process of providing nourishment to a person, such as a bottle to a baby or other person having a limited ability or coordination to move on their own. However, such systems typically have been quite complicated, or in the case of securing a feeding device such as a bottle proximate to the person via use of a collar, relatively dangerous.

The present invention is provided to solve these and other problems.

SUMMARY OF THE INVENTION

It is an object of the invention to provide an apparatus, method and system for supporting an oral device, such as a feeding device containing nourishment, a pacifier, or food item, proximate to the mouth of a person. The present invention reduces the amount of outside assistance required during use of such oral devices. When the oral device is not in use by the person, the invention secures the position of the device thereby preventing the device from falling to the floor or other areas.

The invention is especially adapted for use in conjunction with a baby seat having a rigid handle or superstructure that can be positioned over the infant for attachment of the apparatus. However, it is contemplated that the invention may also be used in conjunction with other objects having a structure that exists above the mouth of the person providing for attachment of the apparatus. One such object is an infant crib.

In accordance with one aspect of the invention, an apparatus is provided for supporting the oral device proximate to the person's mouth. The apparatus comprises a cord having a generally central portion and first and second distal sections. The first and second distal sections terminate at respective first and second ends. Means are provided for adjustably joining a portion of the first distal section to a portion of the second distal section. The adjustably joining means form a loop portion of the cord having an adjustable circumference adapted for adjustably gripping the oral device. In a different embodiment, the cord or the central portion of the cord may be comprised of elasticized material. Means are further provided which are adapted for securing each of the first and second ends to a superstructure.

It is comprehended that the adjustably joining means comprises an adjustable clamp. It is further comprehended that the first and second end adjusting means comprises spring-biased clips.

In accordance with another aspect of the invention, a system is presented for assisting in the process of providing nourishment to a person.

In accordance with this aspect of the invention, the system comprises a body support, such as a seat adapted for receiving the person, and a superstructure disposed above the body support. The superstructure has a portion generally above the mouth of the person received by the body support. A cord is provided having a generally central portion and first and second distal sections. The first and second distal sections terminate at respective first and second ends. Means are provided for adjustably joining portions of the first and second distal sections. The adjustably joining means form a loop portion of the cord having a respectively adjustable circumference adapted for adjustably gripping the oral device. Means are further provided which are adapted for securing each of the first and second ends to the superstructure such that the oral device is maintained at a position generally proximate to the person's mouth.

It is comprehended that the superstructure is affixed to the body support, such as the body support comprising a baby seat and the superstructure comprising a carrying handle for the baby seat.

It is further comprehended that the adjustably joining means comprises an adjustable clamp and that the first and second end adjusting means comprise a spring-biased clip.

It is still further comprehended that the oral device comprises a feeding device for dispensing nourishment such as a baby bottle, a pacifier, or a food item.

It is a still further aspect of the invention to provide a method of providing an oral device to a person.

In accordance with this aspect of the invention, the method comprises providing a body support adapted for receiving the person and providing a superstructure disposed above the body support. The superstructure has a portion generally above the mouth of the person received by the body support. The method further comprises providing a cord, wherein the cord has a generally central portion and first and second distal sections. The first and second distal sections terminate at respective first and second ends. Portions of the first and second distal sections are adjustably joined to form a loop portion of the cord having a respectively adjustable circumference adapted for adjustably gripping the oral device. The oral device is placed in the loop and the size of the loop is adjusted to retain the oral device. Each of the first and second ends are secured to the superstructure such that the retained oral device is maintained at a position generally proximate to the person's mouth.

It is comprehended that the oral device comprises a feeding device containing nourishment, such as a baby bottle, or a pacifier, or food items.

It is further comprehended that the superstructure is affixed to the body support, such as the body support comprising a baby seat and a superstructure comprising a carrying handle for the baby seat.

It is still further comprehended that the adjustably joining means comprises an adjustable clamp, and that the first and second end adjusting means comprises a spring-biased clip.

Other features and advantages of the invention will be apparent from the following specification taken in conjunction with the following drawing.

DETAILED DESCRIPTION

Figure 2:
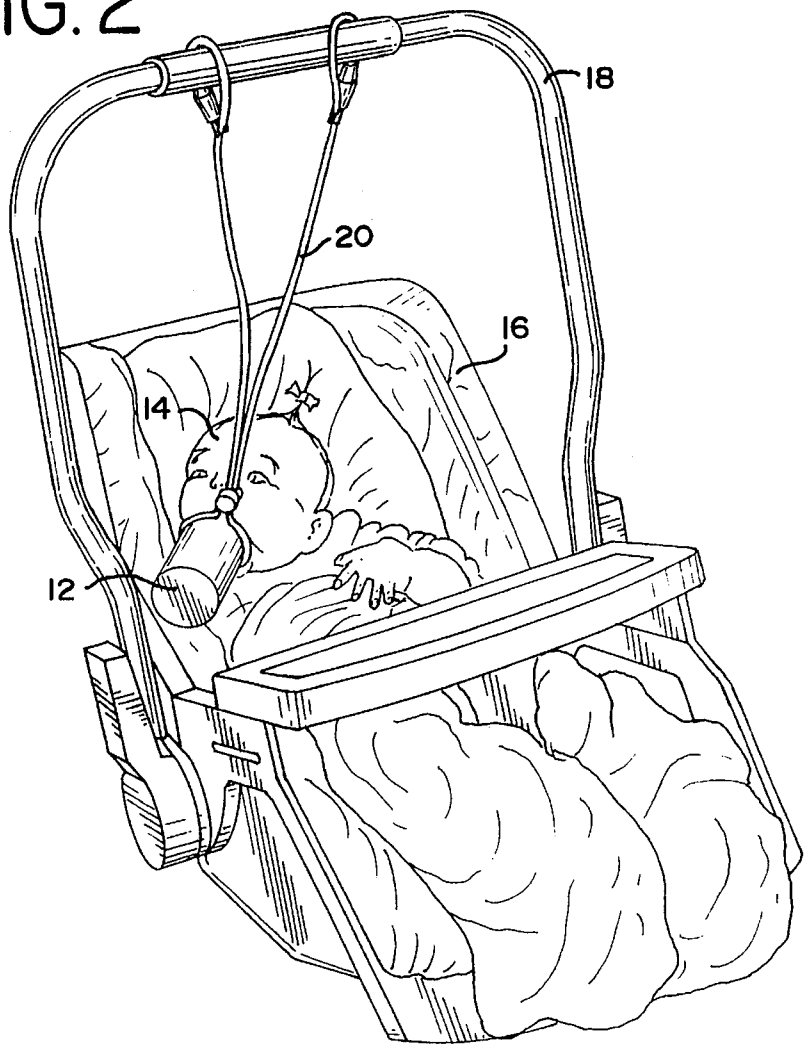
FIG. 2 is a perspective view of the an apparatus of FIG. 1 in use by a baby in a baby seat.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 1:
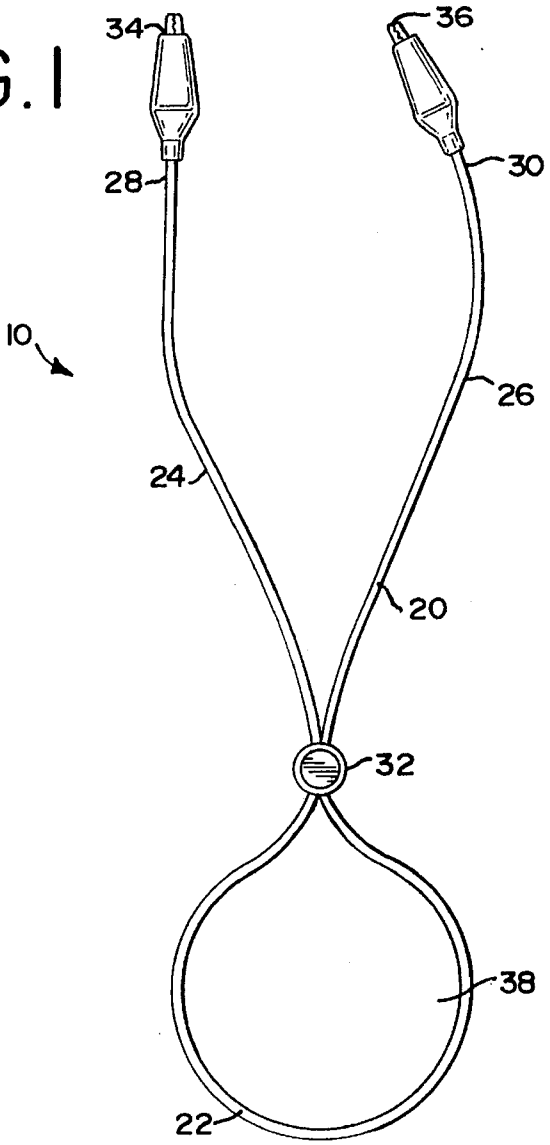
FIG. 1 is a view of an apparatus in accordance with the present invention.

A holder 10 for supporting an oral device, such as a baby bottle 12, proximate to the mouth of a person, such as a baby 14, is illustrated in FIGS. 1 and 2. The baby 14 is disposed on a baby seat 16. The baby seat 16 has a superstructure 18 in the form of a carrying handle, disposed generally above the person.

Referring more particularly to FIG. 1, the holder 10 comprises a cord 20 having a generally central portion 22 and first and second distal sections 24, 26. The first and second distal sections 24, 26 terminate at respective first and second ends 28, 30. A spring biased clamp 32, such as disclosed in U.S. Pat. No. 4,328,605, and sold under the trade name of "Plas-tech" is provided for adjustably joining portions of the first and second distal sections 24, 26. The clamp 32 forms a loop portion, generally designated 38, of the cord 20 having a respectively adjustable circumferential distance adapted for adjustably gripping the bottle 12. Spring-biased clips 34, 36, commonly referred to as alligator clips, are further provided which are adapted for securing each of the first and second ends 28, 30 to the handle 18, as shown in FIG. 2.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of providing a baby bottle or the like with a feeding end inserted into the baby's mouth, said method comprising the steps of:

providing a baby body support adapted for receiving said baby, said baby body support having a portion supporting a baby in a position where the baby's body extends along a given longitudinal axis with the baby's face directed generally upwardly with the baby's mouth located in a given position;

providing a superstructure disposed above said body support, said superstructure having a portion generally above the mouth of the baby received by said body support, said superstructure having a portion extending above the body along an overhead axis extending transversely of said longitudinal axis;

providing a cord having a generally central portion and first and second distal sections, said first and second distal sections terminating at respective first and second ends in respective spring biased clip gripping connectors provided at each of said ends which can be grippingly attached to a selected pair of differently spaced anchoring points which position said central portion of the cord at different selected elevations so that the feeding end of a bottle enveloped by a loop formed in said central portion of the cord can be inserted in the baby's mouth while the cord is hanging from said superstructure portion;

joining portions of said cord to form said loop in the central portion of said cord, said loop having an adjustable circumference adapted for adjustably enveloping and holding said bottle;

placing said bottle in said loop and adjusting the size of said loop to hold said bottle; and attaching said gripping connectors in gripping relation to the selected pair of said anchoring points, to locate the feeding end of said bottle held by the loop of said central portion of the cord at the elevation of the baby's mouth when the cord and bottle are hanging under force of gravity from said overhead superstructure portion; and inserting the feeding end of the bottle in the baby's mouth.

2. The method of claim 1 wherein said body support comprises a baby seat and said superstructure comprises a carrying handle for said baby seat.

3. The method of claim 1 wherein said adjustable circumference of said loop in the cord is obtained by enveloping the joined portions of said cord by an adjustable clamp which is moved along the cord to provide a bottle encircling loop of adjustable size.

4. The method of claim 1 wherein said superstructure portion is a horizontally extending bar which extends laterally transversely of said longitudinal axis and is located generally above the baby's head, and said anchoring points for the gripping connectors are longitudinally spaced pairs of points along said distal sections of said cord to which said connectors may be attached; and before attaching said connectors to the selected pair of anchoring points along the distal sections of said cord looping the first and second ends of the distal sections of the cord around said bar and then attaching said connectors thereto to form loops around said bar at laterally spaced points therealong and of a size to locate the feeding end of said baby bottle encircled by the central portion of the cord in the mouth of the baby with said cord hanging from said bar.

5. A method of providing a baby bottle or the like with a feeding end to be inserted into the baby's mouth, said method comprising the steps of:

providing a baby body support adapted for receiving said baby, said baby body support having a portion supporting a baby in a position where the baby's body extends along a given longitudinal axis, with the baby's face directed generally upwardly with the baby's mouth located in a given position, said baby body support having a superstructure disposed above said body support in the form of a carrying handle for said body support, said superstructure positioned generally vertically above the mouth of the baby received by said body support, said carrying handle including a horizontally extending bar which extends laterally transversely of said longitudinal axis and is located above the baby's mouth;

providing a cord having a generally central portion and first and second distal sections, said first and second distal sections terminating at respective first and second ends of said cord gripping connectors provided at each of said ends which can be grippingly attached to any one of a number of longitudinally spaced pairs of differently spaced anchoring points along the associated distal sections of the cord, to form a pair of laterally spaced loops of a desired circumference surrounding and supported by said bar to position the central portion of the cord when enveloping the bottle at a desired elevation with the feeding end of the bottle next to the baby's mouth;

adjustably joining portions of said first and second distal sections to form an adjustably sized loop portion formed by the central portion of said cord for enveloping and holding said bottle;

placing said bottle in said loop and tightening said loop to retain said bottle;

before attaching said connectors to the selected pair of anchoring points along the distal sections of said cord looping the first and second ends of the distal sections of the cord around said bar and then attaching said connectors thereto to form loops around said bar at laterally spaced points therealong and of a size to locate the feeding end of said baby bottle encircled by the central portion of the cord in the mouth of the baby with said cord hanging from said bar; and inserting the feeding end of said bottle in the baby's mouth.

6. The method of claim 5 wherein each of said gripping connectors is a spring-based clip.

* * * * *